US006764178B2

(12) United States Patent
Chan

(10) Patent No.: US 6,764,178 B2
(45) Date of Patent: Jul. 20, 2004

(54) EYEWEAR CASE

(75) Inventor: Pun How Chan, Shenzhen (CN)

(73) Assignee: Kong Lung Manufactory Limited, Hong Kong (CN)

( * ) Notice: Subject to any disclaimer, the term of this patent is extended or adjusted under 35 U.S.C. 154(b) by 0 days.

(21) Appl. No.: 10/458,884

(22) Filed: Jun. 11, 2003

(65) Prior Publication Data

US 2004/0017541 A1 Jan. 29, 2004

(30) Foreign Application Priority Data

Jul. 10, 2002 (CN) ..... 02271713 U

(51) Int. Cl.[7] ..... G02C 1/00; B65D 85/00
(52) U.S. Cl. ..... 351/158; 206/5; 24/3.8
(58) Field of Search ..... 351/41, 63, 158; 2/454; 206/5; 248/309.1, 902; 24/3.1, 3.3, 3.8; 211/85.1

(56) References Cited

U.S. PATENT DOCUMENTS 4,707,088 A * 11/1987 Tabacchi ..... 351/56
5,949,515 A * 9/1999 Hoshino ..... 351/41
6,145,986 A * 11/2000 Conner ..... 351/158
6,616,274 B1 * 9/2003 Sabia et al. ..... 351/158

* cited by examiner

*Primary Examiner*—Huy Mai
(74) *Attorney, Agent, or Firm*—Alix, Yale & Ristas, LLP

(57) ABSTRACT

An eyewear case has a case-body with an opening at one end. The case has a spring strip which slides along an inside surface of the case-body and operates as a closure to the case as well as an actuator to move a tray within the case-body. The tray supports or holds eyewear, and when the tray is moved upwardly in the case-body, the eyewear becomes accessible through the opening in the case-body. The spring strip has a push-knob fixed to the spring strip and extends through an opening in the case-body.

8 Claims, 2 Drawing Sheets

EYEWEAR CASE

FIELD OF THE INVENTION

The present invention relates to a case for eyewear. More specifically, the present invention relates to a case with a built-in cover that opens and closes by actuation of a slide.

BACKGROUND OF THE INVENTION

At present, there are a great variety of eyewear cases in the market. These cases are often intended to store and protect eyewear such as prescription and non-prescription glasses, and sunglasses. A majority of such cases are composed of a top cover and bottom cover that are held together by elastic tension of, for instance, a spring. If the force holding the two covers together is too small, the case will not close tightly. This may result in the glasses dropping out of the case which may result in damage to fragile and expensive eyewear. If the force holding the two covers together is too large, the case is not easily opened. This problem is especially acute for the presbyopia users, since the glasses could easily be suddenly dislodged and dropped at the moment the case is opened due to the force necessary overcome the elastic tension. In addition, some eyewear cases are fitted with a soft upper-cover, one end of which is fitted onto the case body, and the other end is fixed firmly onto another point of the case-body. These cases also have the shortcoming of inconvenient and/or erratic opening and have an imperfect appearance.

SUMMARY OF THE INVENTION

Briefly stated, the invention in a preferred form is an eyewear case with a built-in cover that is simple in structure and easy to open.

More specifically, the eyewear case includes a case-body having an opening at one end through which eyewear may pass. A spring strip is slide-fitted in the inner surface of case-body, and a slide channel opening is present in the wall of the case-body to allow access to the spring strip. A push-knob extends through the slide channel and is fixed onto the spring strip.

A tray is present within the case-body. The tray is configured to provide support for the eyewear, and has an opening that is orientated upward in the direction of the case-body opening. The tray is slide-fitted within the case-body. A magnet is part of and/or fixed to the tray in a position close to the inner wall of the case-body. The spring strip extends along the inner wall of case-body to the opposite inner wall. The spring strip has a magnetic piece on its extending tip. The case-body is provided with slide way in its inner wall, through which the spring strip is slide-fitted in the case body. The length of the spring strip is such that there may be a separating distance between the tray and the spring strip end that corresponds with the length of the channel opening on the case-body.

An object of the invention is to provide an eyewear case which opens in an efficient and reliable manner. Since the reading glasses inside the case will rise in synchronicity to the user's had activation such that the user can lift up the glasses from the case when desired.

BRIEF DESCRIPTION OF THE DRAWINGS

Other objects and advantages of the invention will be evident to one of ordinary skill in the art from the following detailed description with reference to the accompanying drawings, in which.

DETAILED DESCRIPTION OF THE PREFERRED EMBODIMENT

Figure 1:
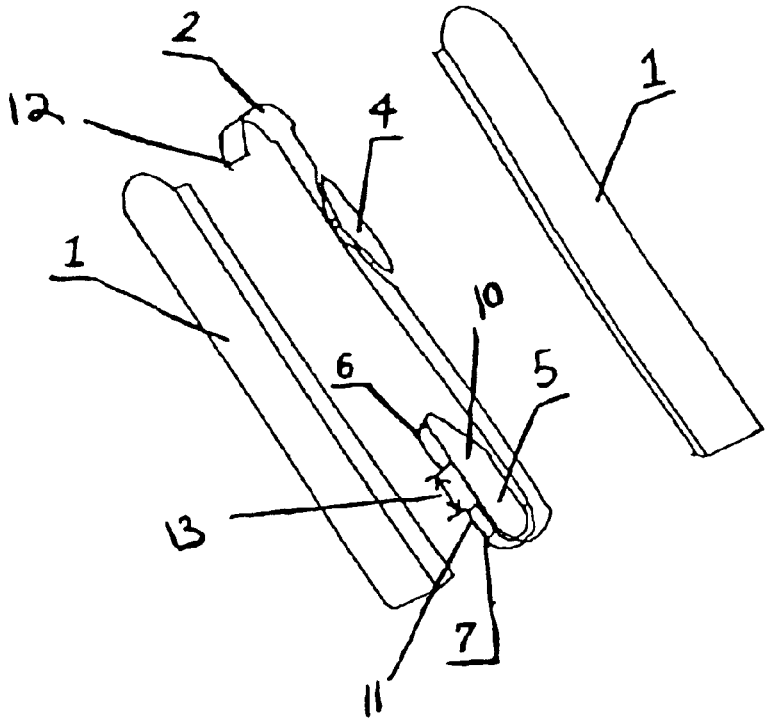
FIG. 1 is an exploded view of an eyewear case consistent with the present invention.
Figure 2:
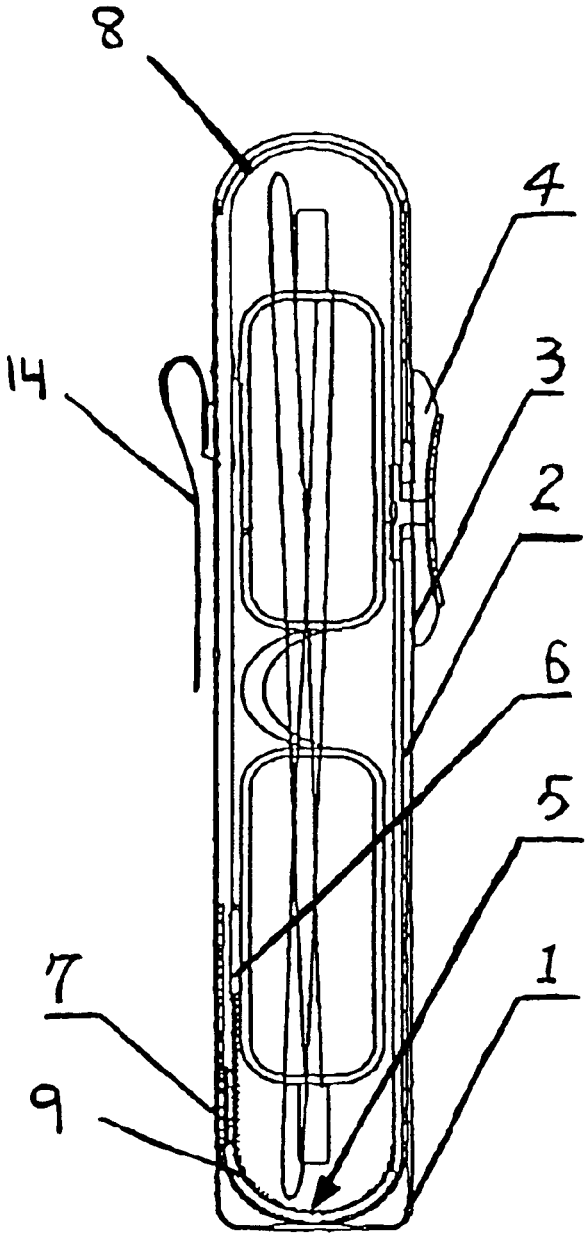
FIG. 2 is a sectional view of an eyewear case consistent with the present invention and further illustrating eyewear contained therein.

As shown in FIG. 1 and FIG. 2, one embodiment of the invention includes a case-body 1. The case-body 1 may have a shape that is generally cylindrical with an opening 8 at one end. A spring strip 2 is slide-fitted in the inner surface of case-body 1. A slide channel 9 may be present on the wall of the case-body 1, which retains the spring strip near the case-body wall and guides the spring strip. The slide channel may be arc-shaped on the bottom of the case and corresponds in width with the width of spring strip 2. A slide channel opening 3 allows access to the spring strip 2. The slide channel opening may be an elongated slit that runs along a side of the case body. A push-knob 4 extends through the slide channel opening 3 and is fixed onto spring strip 2. Movement of the push knob 4 along the length of the slide channel opening 3 thus moves the spring strip 2.

The spring strip 2 can be formed of steel, stainless steel, polymeric material, and/or other material well known in the art, such as hard strips with a bendable surface. The slide channel opening 3 has a length, which depends on the length of the opening 8. The opening 8 has a portion of the slide channel 9 that guides the spring strip 2 across its length such that when the push knob 4 is pushed upward, a closure end 12 of the spring strip traverses the length of the opening 8 and the spring strip seals off the opening 8.

A tray 5 with an opening 10 that opens in the direction of the opening 8 is present within the case-body. The tray is slide-fitted in case-body 1, for instance the mid-lower part. A magnet 6 is fixed on tray 5 in the position close to the inner wall of case-body 1. The spring strip 2 extends from at least the slide channel opening 3 along the inner wall of case-body I to the opposite inner wall. A magnetic piece 7 on a spring strip tray engagement end 11 magnetically interacts with the magnet 6. The spring strip when moved with the push knob 4 causes the tray 5 to move during at least a portion of its travel. This can occur where the magnet 6 and the magnetic piece 7 interact, for instance, when the push knob is pushed upward the magnet 6 pulls the tray downward until it reaches the end of that tray's travel.

Once the tray is at the limit of its downward travel, the force on the knob then may overcome the magnetic force between the magnet 6 and the magnetic piece 7. A distance 13 is then created between the tray engagement end 11 of the spring strip 2, which has a magnet 6, and the magnetic piece 7 on the tray 5. The separating distance between the tray engagement end 11 and the magnetic piece 7 corresponds with the length of the channel opening 8 on case-body 1. Thus, when the push knob 4 is pushed to the upper limit of the slide channel opening 3, the spring strip seals off the opening 8. When the push knob 4 is moved downward, the opening 8 is unsealed and the tray engagement end 11 of the spring strip 2 moves to contact the tray 5. The tray 5 then is moved upward in the body case 1 in the direction of the opening 8. The glasses inside the case can thereby move upward and downward with the movement of the tray 5.

In one embodiment of the invention, the end of the case-body 1 with the opening 8 has the shape of a circular arc, thus making the spring strip 2 easy to slide. For example, the slide channel at the bottom of the case is arc-shaped and corresponds in width with the width of the spring strip 2.

In one embodiment of the invention, the push knob 4 is fitted with an outer plastic surface. This surface may be textured or otherwise shaped and/or configured to promote traction between, for example, the thumb and the push knob 4. The push knob 4 can also adopt other friction means well known in the art.

In one embodiment of the invention, the exterior of the case-body may be fitted with an attachment clip 14. The clip may be attached to make the case convenient to carry and may for example attach to a pocket, waistband, or belt.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. An eyewear case comprising;

a case-body having an eyewear opening, a slide channel opening an inner surface;

a spring strip slide-fitted in the inner surface of the case-body, the spring strip having a tray engagement end and a closure end;

a push-knob that extends through the slide channel opening and is affixed to the spring strip;

a tray slide-fitted within the case-body, said tray having a cooperating surface with the spring strip engagement end.

2. The case as described in claim 1 further comprising the tray having an opening which opens in the direction of the case-body eyewear opening, said tray slide-fitted in a mid-lower part of the case-body;

a magnet fixed to the tray in a position close to the inner surface of the case-body;

said spring strip extending along the inner surface of the case-body and having a magnetic piece wherein the tray engagement end magnetically interacts with the magnet to make the tray move during a portion of a movement of the spring strip.

3. The case in claim 2 wherein the magnet and the magnetic piece become separated during movement of the spring strip, and the separating distance between said magnetic piece and the magnet corresponds with the length of the case-body opening.

4. The case in claim 1, further comprising the case-body having a slide channel in its inner wall, through which spring strip is slide-fitted in case-body.

5. The case in claim 1 wherein the eyewear opening of the case-body has side walls that are in the shape of a circular arc.

6. The case in claim 5 wherein the slide channel at the bottom of the case is arc-shaped and corresponds in width with a width of the spring strip.

7. The case in claim 1 wherein said push knob 4 is fitted with an outer plastic layer.

8. The case in claim 1, wherein the case-body has an attachment.

* * * * *